US006883677B2

(12) United States Patent
Goeking et al.

(10) Patent No.: US 6,883,677 B2
(45) Date of Patent: Apr. 26, 2005

(54) DISPOSABLE DRINKING DEVICE

(75) Inventors: Harold J. Goeking, Oshkosh, WI (US); Rebecca E. Whitmore, Chilton, WI (US); William Schultz, Atlanta, GA (US); Janica S. Behnke, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 10/402,718

(22) Filed: Mar. 28, 2003

(65) Prior Publication Data

US 2004/0200849 A1 Oct. 14, 2004

(51) Int. Cl.[7] ..... A47G 19/22
(52) U.S. Cl. ..... 220/713; 220/619
(58) Field of Search ..... 220/717, 713, 220/691, 703, 704, 711, 716, 615–623; 215/DIG. 7, 387

(56) References Cited

U.S. PATENT DOCUMENTS

| | | | | | |
|---|---|---|---|---|---|
| 2,816,548 | A | * | 12/1957 | Tupper | 215/11.1 |
| 3,883,036 | A | * | 5/1975 | Mahaffy et al. | 220/781 |
| 4,421,244 | A | * | 12/1983 | Van Melle | 220/781 |
| 4,756,440 | A | * | 7/1988 | Gartner | 220/711 |
| 4,795,052 | A | | 1/1989 | Hayes, Jr. | 220/90.4 |
| 4,915,250 | A | | 4/1990 | Hayes, Jr. | 220/90.4 |
| 5,186,347 | A | * | 2/1993 | Freeman et al. | 220/254.1 |
| 5,213,236 | A | | 5/1993 | Brown et al. | 222/185 |
| 5,253,781 | A | * | 10/1993 | Van Melle et al. | 220/713 |
| 5,273,172 | A | | 12/1993 | Rossbach et al. | 215/229 |
| 5,339,995 | A | | 8/1994 | Brown et al. | 222/185 |
| 5,363,983 | A | * | 11/1994 | Proshan | 220/717 |
| 5,377,877 | A | | 1/1995 | Brown et al. | 222/105 |
| 5,392,968 | A | | 2/1995 | Dark | 222/529 |
| 5,409,144 | A | | 4/1995 | Brown | 222/185 |
| 5,439,143 | A | | 8/1995 | Brown et al. | 222/185 |
| 5,538,157 | A | * | 7/1996 | Proshan | 220/717 |
| 5,542,670 | A | | 8/1996 | Morano | 220/714 |
| 5,645,191 | A | | 7/1997 | Neville | 220/717 |
| D385,748 | S | | 11/1997 | Iodice et al. | D7/510 |
| D397,906 | S | | 9/1998 | Briggs et al. | D7/392.1 |
| 6,047,851 | A | * | 4/2000 | Freek et al. | 220/780 |
| 6,102,245 | A | | 8/2000 | Haberman | 220/714 |
| 6,112,926 | A | * | 9/2000 | Fishman | 215/389 |
| 6,571,981 | B1 | | 6/2003 | Rohlfs | 220/713 |
| 6,612,456 | B1 | * | 9/2003 | Hundley et al. | 220/254.3 |
| 2003/0066839 | A1 | | 4/2003 | Connor, Jr. et al. | 220/713 |
| 2003/0085232 | A1 | | 5/2003 | Leinenweber | 220/705 |
| 2004/0031714 | A1 | * | 2/2004 | Hason | |

OTHER PUBLICATIONS

Advertisement "The First Years Take & Toss Spill–Proof 10 oz. Cups, from 9 Months", http://www.drugstore.com.

* cited by examiner

*Primary Examiner*—Lien M. Ngo
(74) *Attorney, Agent, or Firm*—Fulbright & Jaworski, L.L.P.

(57) ABSTRACT

A disposable drinking device comprising a cup is disclosed. The cup defines a cup cavity and comprises a cup opening communicated with the cup cavity and a cup brim annularly associated with the cup opening. The cup brim comprises a brim curl having a lip configuration and a flare configuration. When the brim curl is in the lip configuration, the brim curl arcuately and concavely extends away from the cup opening to form a brim lip. When the brim curl is in the flare configuration, the brim curl arcuately and convexly extends away from the cup opening to form a brim flare. The described configuration results in the cup brim being destroyed when the lid is removed from the cup, making subsequent re-capping impossible.

28 Claims, 11 Drawing Sheets

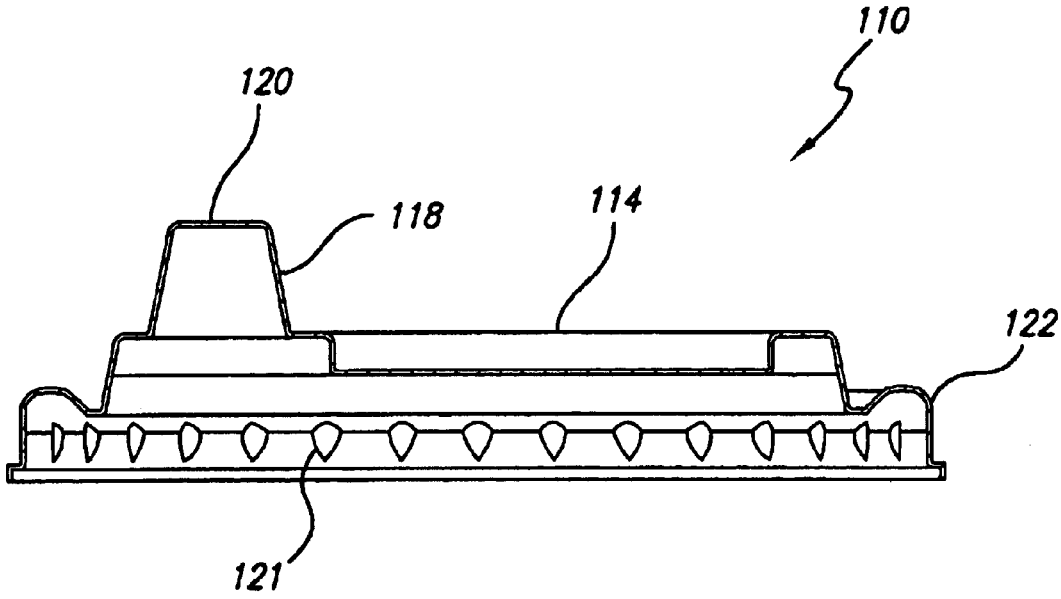
FIG. 3
FIG. 4
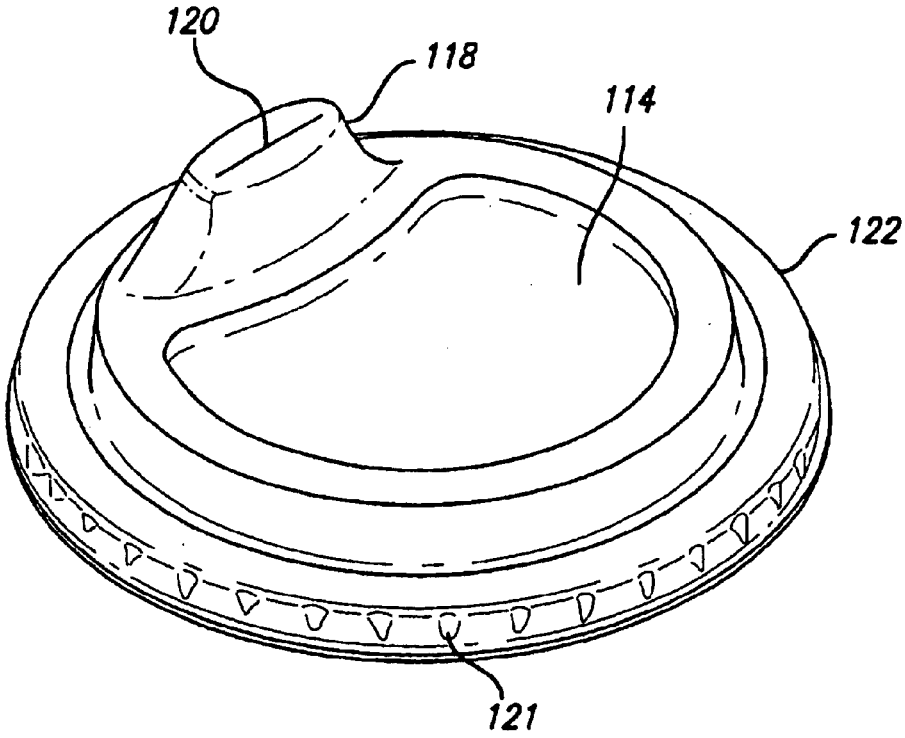

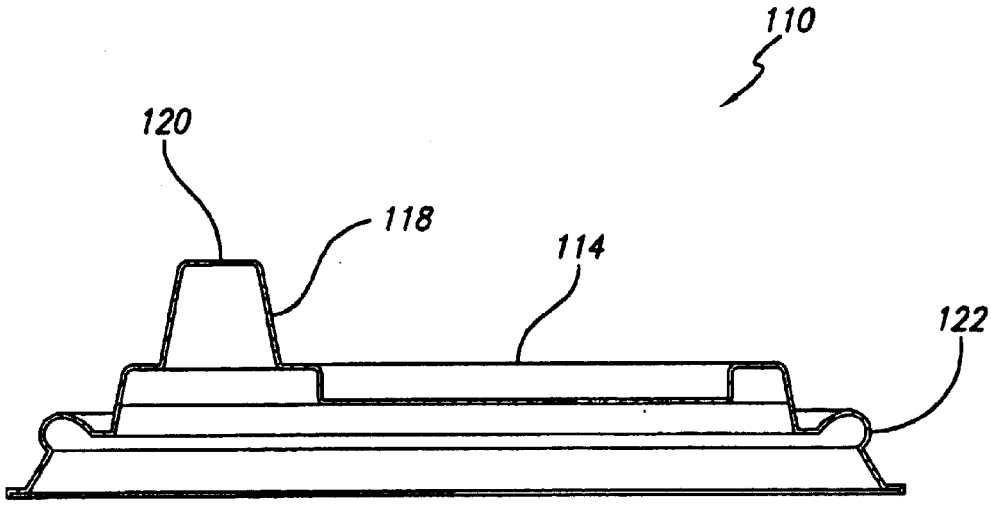
FIG. 5
FIG. 6
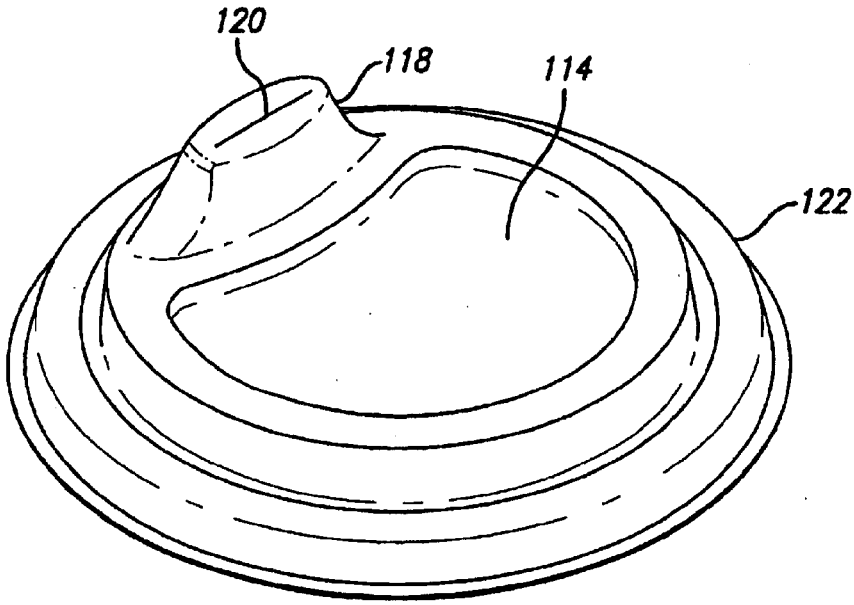

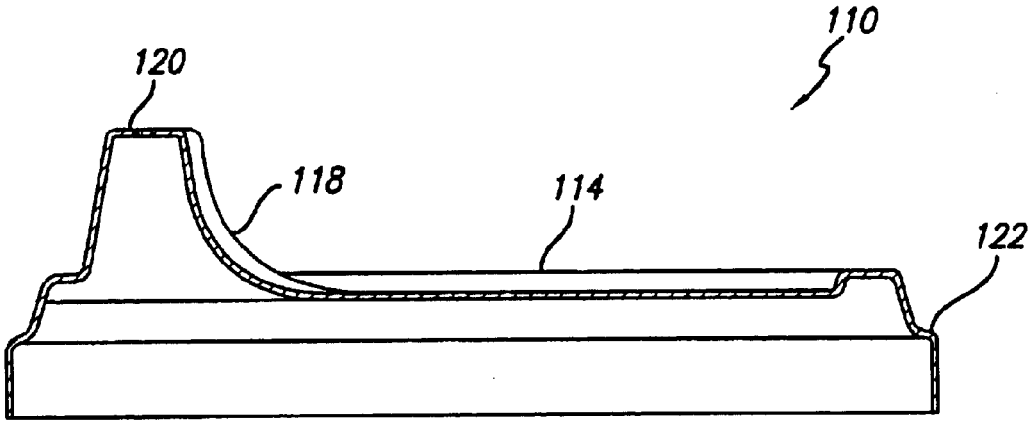
FIG. 9
FIG. 10
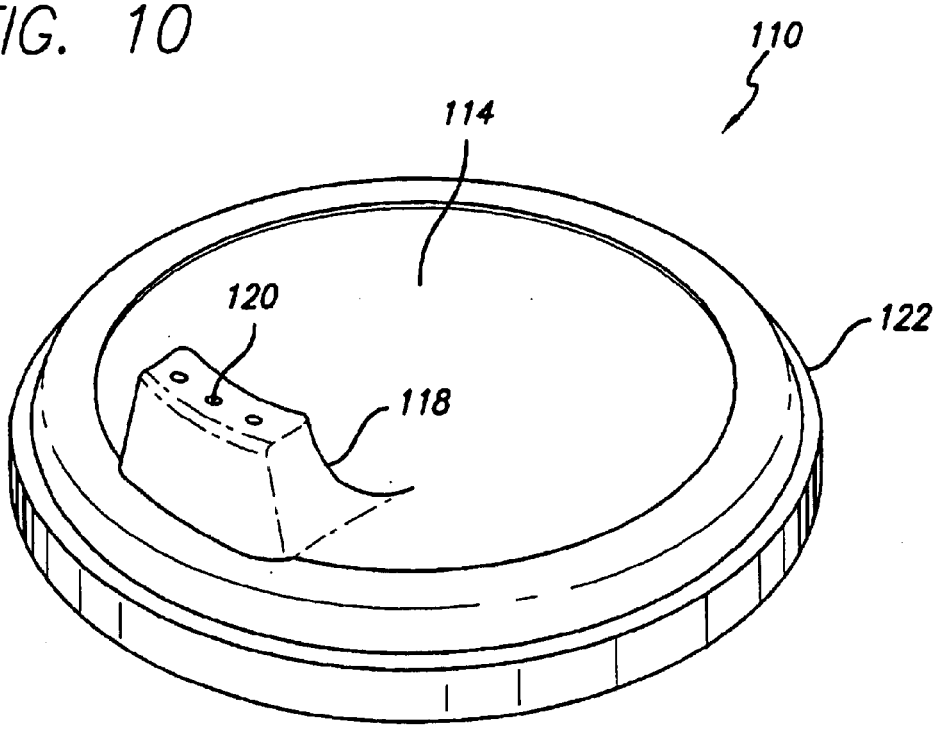

DISPOSABLE DRINKING DEVICE

FIELD OF THE INVENTION

This invention relates generally to a disposable drinking device and more particularly to a leak resistant disposable drinking device suitable for use by young children.

BACKGROUND OF THE INVENTION

Sippy cups, or drinking devices suitable for use by young children, are designed to contain a liquid and allow for the controlled release of the liquid in a manner responsive to the action of a user. For example, a sippy cup which includes a straw having a one-way valve will not release the liquid from the cup until suction is applied to the straw. The applied suction opens the one-way valve allowing the liquid to flow through the straw and out of the cup. When no suction is applied, the one-way valve remains closed and the liquid remains within the cup. Due to their fluid release control characteristics, sippy cups are typically used to help a child develop the fine motor skills needed to drink from a cup without spilling. Since young children have not yet developed these motor skills, these cups have to be spill and leak resistant, easy to use, as well as provide some tactile stimulation to encourage the child to drink. Moreover, these cups need to be relatively strong and durable in order to provide some protection from the child spilling the liquid from the cup.

At present, a number of manufacturers produce a variety of non-disposable sippy cup designs with an enhanced leak resistance capability, a soft touch effect for tactile stimulation and sufficient strength and durability. These sippy cup designs provide a cup having a removable cup lid for filling and re-filling the cup with liquid. However, because sippy cups are often filled, and then re-filled or 'topped-off', with drinks that have a high sugar content, such as juice or milk, the sippy cup provides an excellent environment for bacterial colonization and propagation. This increases the likelihood of the child developing an illness caused by bacterial colonization of the liquid in the cup prior to re-filling.

Most of the sippy cups are manufactured by an injection molding process in order to acquire sufficient strength and durability. Although the injection molding process creates a strong and durable cup, these cups are typically expensive to manufacture and are thus non-disposable. In addition, these cups are difficult to clean, difficult to stack and inconvenient for parents to transport away from home due to the number of cups required and the maintenance required to keep these cups clean. These injection molded cups may also include over-molded or dual shot molded features for decoration and soft touch effects adding to the cost, maintenance and transportability problem. Furthermore, most existing sippy cup designs include relatively thick walls and are of a fairly heavy construction. As such, even though a cup may be disposable, consumers may not feel that it is disposable and thus may be hesitant to discard the cup.

Therefore, it would be desirable to provide a truly disposable and inexpensive single use sippy cup which may be easily transported and discarded after use.

SUMMARY OF THE INVENTION

The above discussed need is addressed by a disposable drinking device comprising: a cup, wherein the cup defines a cup cavity and includes a cup opening communicated with the cup cavity and a cup brim annularly associated with the cup opening, wherein the cup brim includes a brim curl having a lip configuration and a flare configuration, wherein when the brim curl is in the lip configuration the brim curl arcuately and concavely extends away from the cup opening to form a brim lip and wherein when the brim curl is in the flare configuration, the brim curl arcuately and convexly extends away from the cup opening to form a brim flare; and a thermoformed lid having a lid crown and a lid skirt, wherein the lid crown includes a crown top, a crown bottom and a spout having a spout opening disposed to communicate the crown top with the crown bottom, and wherein the lid skirt includes an angular rim having an internal rim surface, wherein when the lid is snap-fittingly associated with the cup, the brim curl is in the lip configuration and the internal rim surface is securely associated with the brim lip, such that when the lid is disassociated from the cup, the internal rim surface forcingly configures the brim curl into the flare configuration.

A disposable lid comprising: a thermoformed lid crown, wherein the lid crown includes a crown top, a crown bottom and a protruding spout having a spout opening disposed to communicate the crown top with the crown bottom; and a thermoformed lid skirt, wherein the lid skirt includes an angular rim having an internal rim surface, wherein the lid skirt is shaped to allow the lid to securely associate with a cup having a brim curl, wherein when the lid is disassociated from the cup the internal rim surface causes the brim curl to change configurations.

A disposable cup comprising: a cup wall defining a cup cavity and including a cup opening communicated with the cup cavity and a cup brim annularly associated with the cup opening, wherein the cup brim includes a partially formed brim curl having a lip configuration and a flare configuration, wherein when the brim curl is in the lip configuration the brim curl arcuately and concavely extends away from the cup opening to form a brim lip and wherein when the brim curl is in the flare configuration, the brim curl arcuately and convexly extends away from the cup opening to form a brim flare.

A method for implementing a disposable drinking device comprising: obtaining a disposable lid and a disposable cup, wherein the lid includes a lid skirt having an angular rim, and wherein the cup includes a cup opening, a cup brim and defines a cup cavity, the cup brim having a brim curl, wherein the brim curl includes a lip configuration and a flare configuration; inserting a liquid into the cup cavity; arranging the lid and the cup such that the lid is loosely associated with the cup brim so as to enclose the cup cavity; and compressing the lid onto the cup brim such that the angular rim is fasteningly associated with the brim curl.

The above discussed and other features and advantages of the present invention will be appreciated and understood by those skilled in the art from the following detailed description and drawings.

BRIEF DESCRIPTION OF THE DRAWINGS

Referring to the exemplary drawings wherein like elements are numbered alike in the several Figures:

FIG. 3 is a cross sectional side view of a disposable lid;

FIG. 4 is a perspective view of a disposable lid;

FIG. 5 is a cross sectional side view of an alternative embodiment of a disposable lid;

FIG. 6 is a perspective view of an alternative embodiment of a disposable lid;

FIG. 9 is a cross sectional side view of a third alternative embodiment of a disposable lid;

FIG. 10 is a perspective view of a third alternative embodiment of a disposable lid;

DETAILED DESCRIPTION OF THE INVENTION

Figure 1:
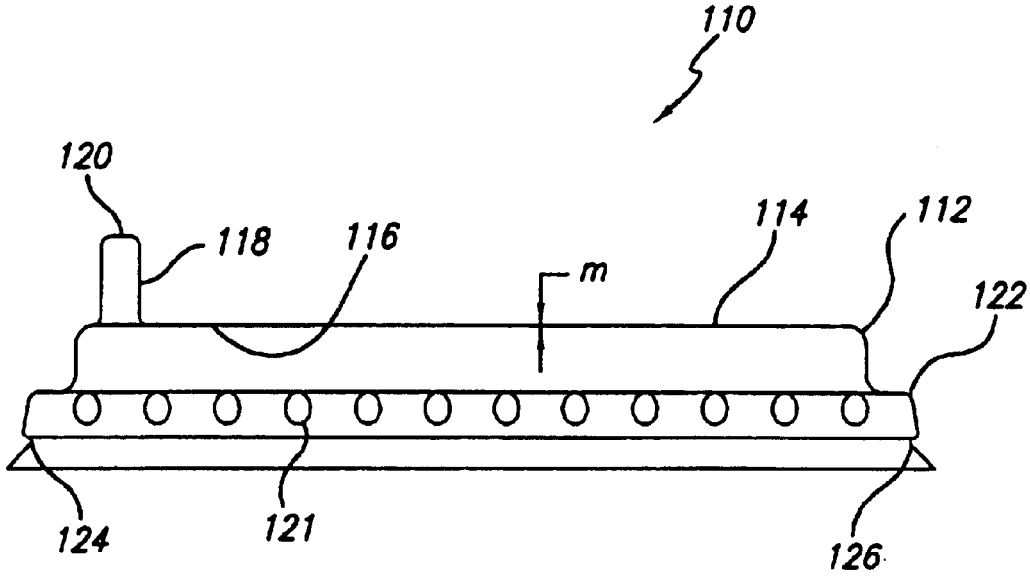
FIG. 1 is a cross sectional side view of a disposable lid.

Referring to FIG. 1, a disposable lid 110 is shown and described in accordance with an exemplary embodiment. Lid 110 preferably includes a lid crown 112 having a crown top 114, a crown bottom 116, and a protruding lid spout 118 associated with lid crown 112 and including a spout opening 120. Lid 110 also includes a lid skirt 122 having ribs 121, a skirt diameter a and an angular rim 124, wherein angular rim 124 includes a rim diameter b and an internal rim surface 126, wherein, ribs 121 are disposed to securely associate disposable lid 110 with the brim of a disposable cup.

Figure 2:
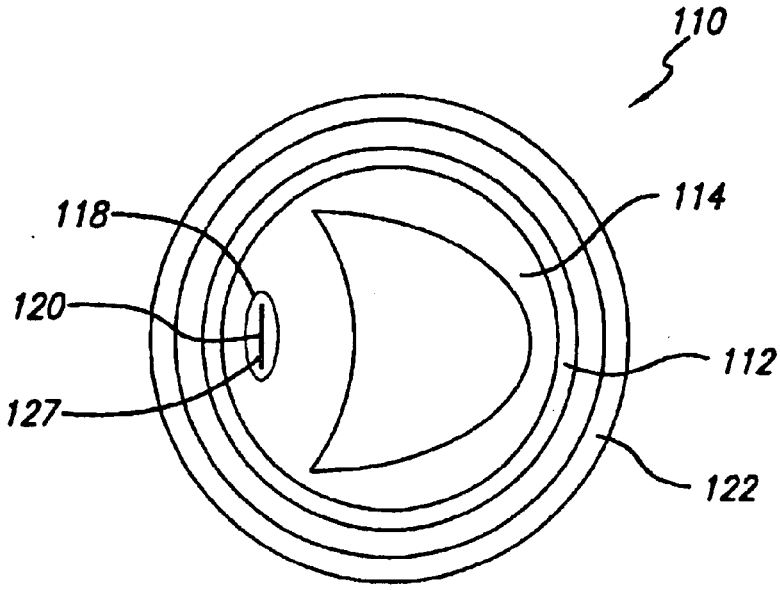
FIG. 2 is a top view of a disposable lid.

Referring to FIG. 2, FIG. 3 and FIG. 4, disposable lid 110 is again illustrated and spout opening 120 is shown. Spout opening 120 includes an opening border 127 and is preferably disposed to communicate crown top 114 with crown bottom 116. Although lid 110 includes a lid thickness m, wherein lid thickness m is between about $^{9}/_{1000}$ inch and about $^{25}/_{1000}$ inch, lid thickness m is preferably about $^{10}/_{1000}$ inch. This advantageously allows for a relatively strong, durable and truly disposable cup lid 110. In addition, lid 110 is constructed using a thermoform process and is preferably constructed of a translucent plastic and/or composite material. However, lid 110 may be constructed of any material and/or combination of materials suitable to the desired end purpose, such polyester (APET), polypropylene or polyethylene—alone or as a coating on a paperboard substrate, which would be much more suitable from a child safety standpoint. Lid spout 118 is preferably a protruding spout which extends upward from crown top 114 to facilitate 'sipping' action from a user and includes at least one small spout opening 120 which allows for small children to suck liquid 150 out of cup cavity 134 while maintaining some level of spill/leak resistance. Lid spout 118 may be constructed using a thermoform process and spout opening 120 may include a plurality of holes or may be a self healing razor slit. This self healing razor slit may include an opening border 127, which is sized and/or shaped to flexibly, deformably and resiliently increase in size to dispense liquid when suction is applied to lid spout 118. When suction is not applied to lid spout 118, the self healing nature of opening border 127 allows opening border 127 to return to its original size to prevent liquid from escaping from spout opening 120. Self healing razor slits are not present in injection molded lids because injection molded lids are thicker and less resilient than thermoformed lids. Thus, this self healing razor slit advantageously provides for a greater leak resistance capability than is possible with injection molded lids that do not have insert molded or assembled elastomeric valves.

Referring to FIG. 5 and FIG. 6, a cross sectional side view and a perspective view, respectively, of an alternative embodiment of disposable lid 110 is illustrated. Disposable lid 110 includes a protruding lid spout 118 having a spout opening 120. It should be appreciated that spout opening 120 may include a self healing razor slit or a plurality of holes for dispensing liquid when suction is applied to protruding lid spout 118.

Figure 7:
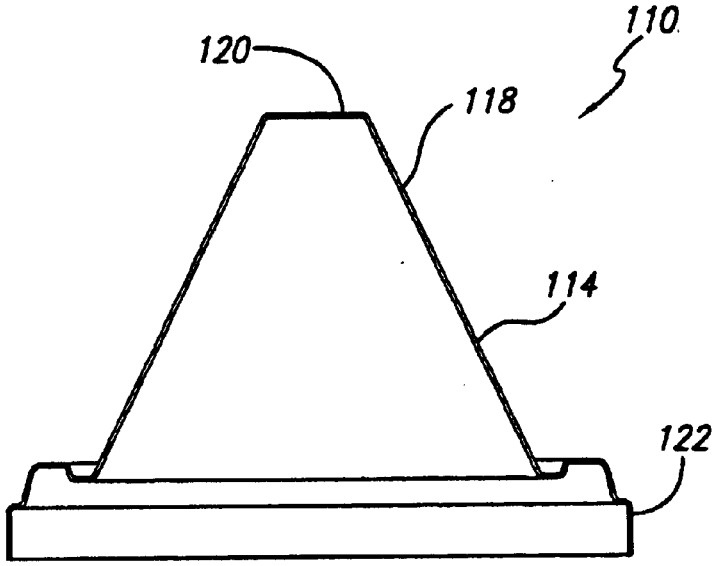
FIG. 7 is a cross sectional side view of a second alternative embodiment of a disposable lid.
Figure 8:
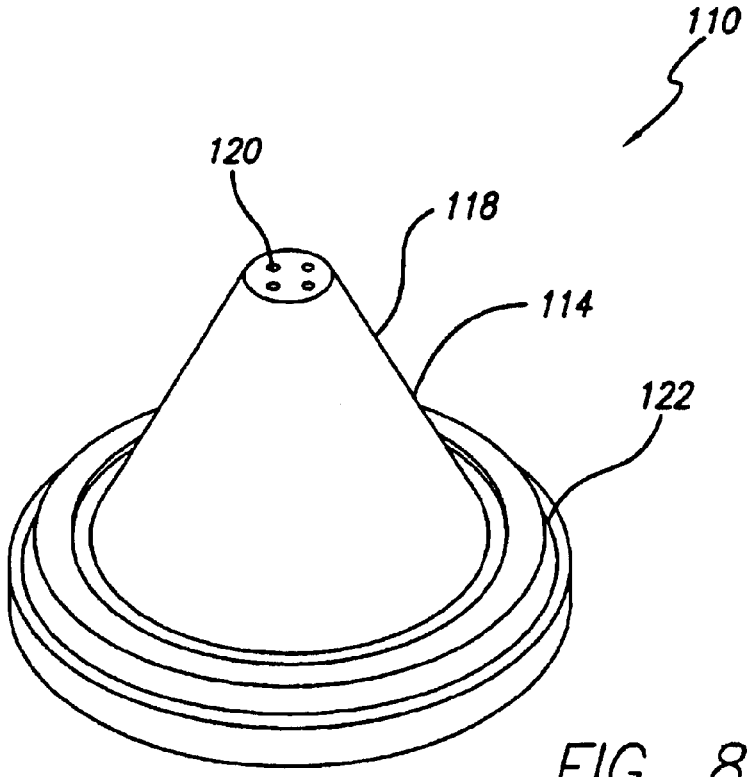
FIG. 8 is a perspective view of a second alternative embodiment of a disposable lid.

Referring to FIG. 7 and FIG. 8, a cross sectional side view and a perspective view, respectively, of a second alternative embodiment of disposable lid 110 is illustrated and includes a cone shaped lid spout 118 protruding from disposable lid 110. As can be seen, cone shaped protruding lid spout 118 originates in the center of disposable lid 110 and includes spout opening 120, which may include a self healing razor slit or a plurality of holes for dispensing liquid when suction is applied to cone shaped protruding lid spout 118.

Referring to FIG. 9 and FIG. 10, a cross sectional side view and a perspective view, respectively, of a third alternative embodiment of a disposable lid is illustrated. Disposable lid 110 includes a protruding lid spout 118 having a spout opening 120. It should be appreciated that although spout opening 120 is shown has having a plurality of holes for dispensing a liquid when suction is applied to protruding lid spout 118, protruding lid spout 118 may include a self healing razor slit as spout opening 120. It should also be appreciated that protruding lid spout 118 is preferably sized and shaped to achieve a pleasing and/or stimulating tactile response from a user.

Figure 11:
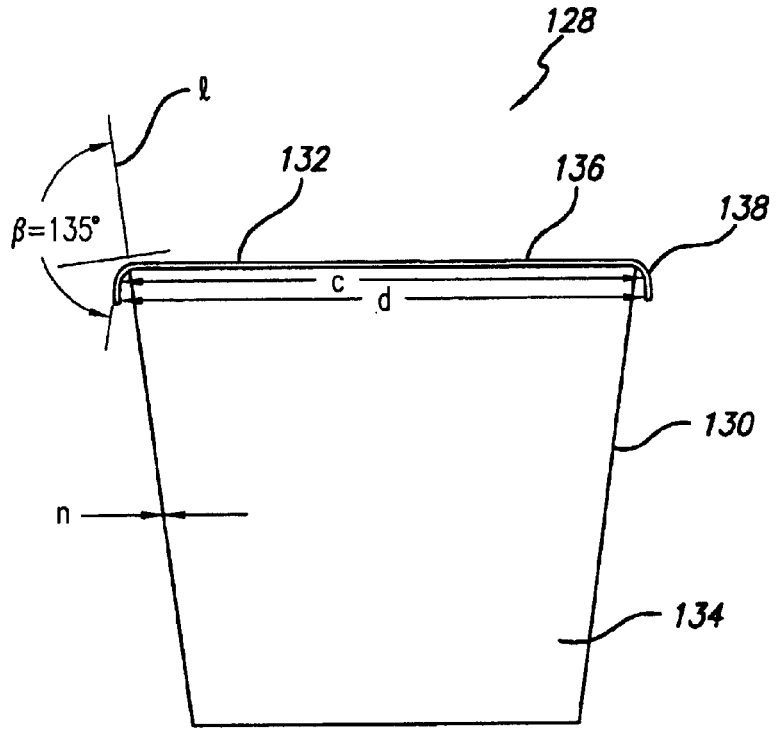
FIG. 11 is a cross sectional side view of a disposable cup having a brim curl with an arc angle of 135°.
Figure 12:
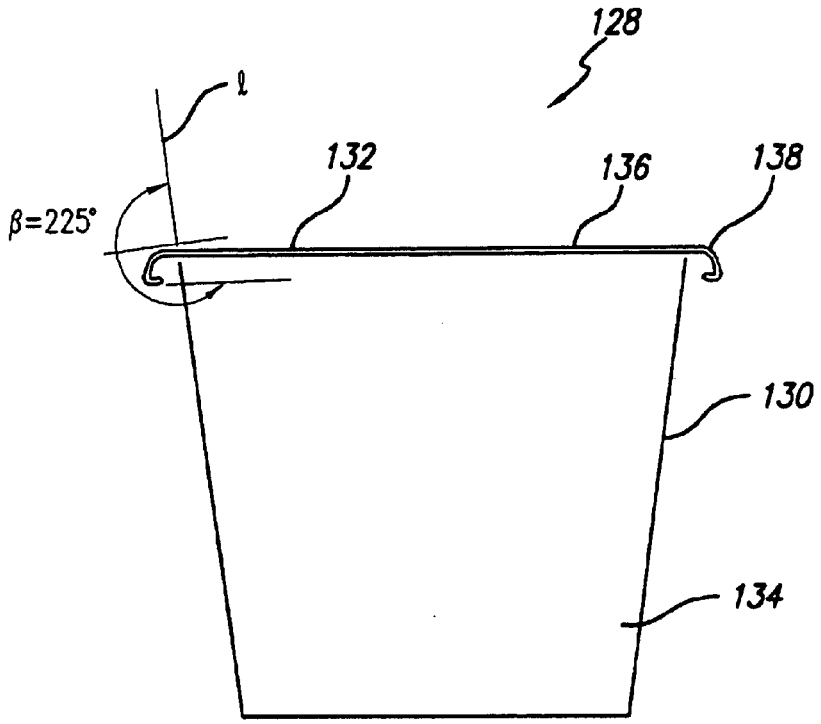
FIG. 12 is a cross sectional side view of a disposable cup having a brim curl with an arc angle of 225°.
Figure 13:
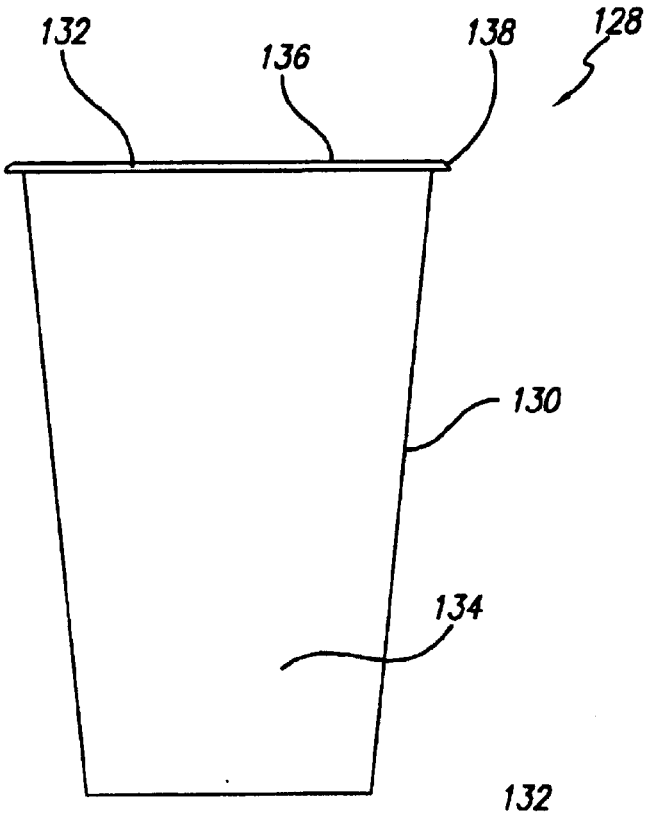
FIG. 13 is a side view of a disposable cup.
Figure 14:
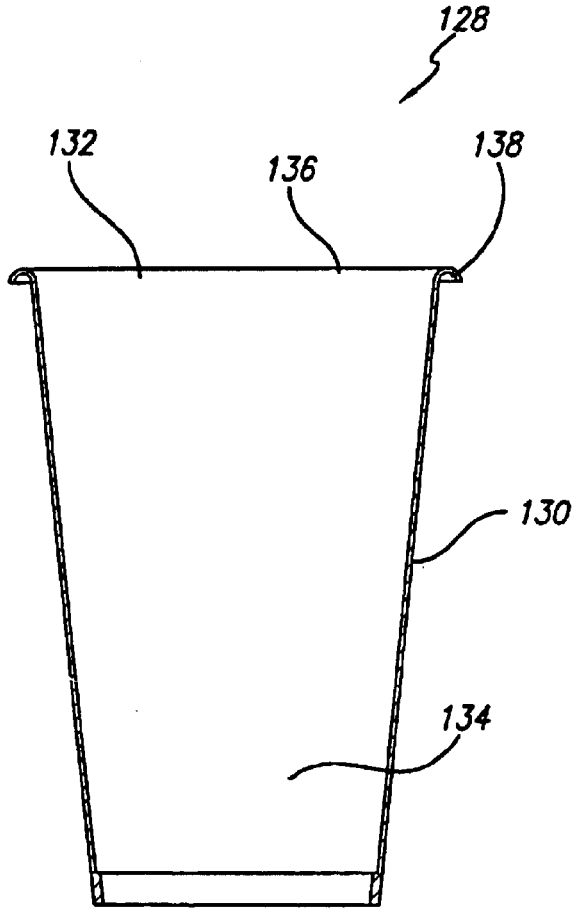
FIG. 14 is a cross sectional side view of a disposable cup.
Figure 15:
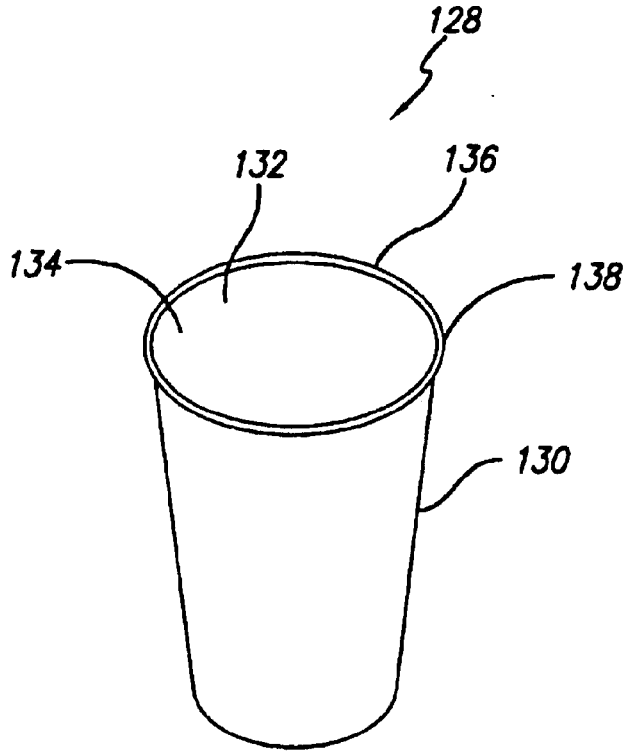
FIG. 15 is a perspective view of a disposable cup.

Referring to FIG. 11, a disposable cup 128 is shown and described. Cup 128 is constructed using a thermoform process and includes a cup wall 130 having a cup opening 132 and defining a cup cavity 134. Cup wall 130 also includes a cup brim 136 annularly associated with cup opening 132, wherein cup brim 136 includes a partially formed brim curl 138 having an arc angle β between about 135° to about 225° from an imaginary line I disposed tangent to cup wall 130. Referring to FIG. 11, a cup 128 having a brim curl 138 with an arc angle β of about 135° from an imaginary line I disposed tangent to cup wall 130 is shown. Referring to FIG. 12, a cup 128 having a brim curl 138 with an arc angle β of about 225° from an imaginary line I disposed tangent to cup wall 130 is shown. Referring to FIGS. 13, 14 and 15, a side view, a cross-sectional view and a perspective view, respectively, of a disposable cup 128 is illustrated and includes a partially formed brim curl 138.

Figure 16:
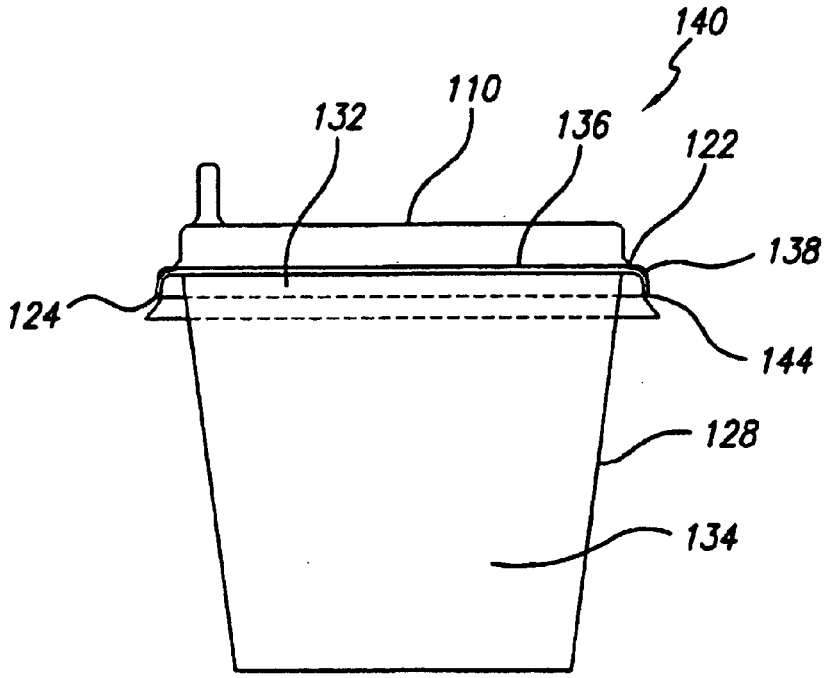
FIG. 16 is a cross-sectional side view of a disposable drinking device showing a lid associated with a cup with the brim curl in lip configuration.
Figure 17:
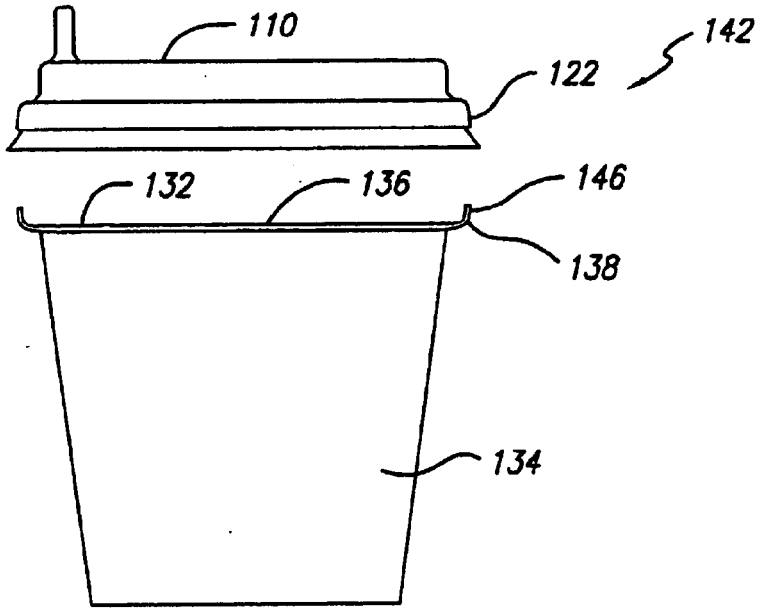
FIG. 17 is a cross-sectional side view of a disposable drinking device showing a lid disassociated with a cup with the brim curl in flare configuration.

In addition, disposable cup 128 having partially formed brim curl 138 includes a lip configuration 140, as shown in FIG. 16, and a flare configuration 142, as shown in FIG. 17. Referring to FIG. 16, when brim curl 138 is in lip configuration 140, brim curl 138 arcuately and concavely extends away from cup opening 132 to form a brim lip 144. Referring to FIG. 17, when brim curl 138 is in flare configuration 142, brim curl 138 arcuately and convexly extends away from cup opening 132 to form a brim flare 146. It should be appreciated, that by using partially formed brim curl 138 in combination with disposable lid 110, or in combination with conventional lids, will provide for an enhanced lid retention.

Referring again to FIGS. 11 and 16, cup brim 136 also includes a brim curl diameter c sized relative to skirt diameter a to allow brim curl 138 to sealingly associate with lid skirt 122 of lid 110 when lid 110 is snap-fittingly associated with cup 128. Moreover, brim lip 144 includes a lip diameter d sized relative to rim diameter b to allow brim lip 144 to fasteningly associate with angular rim 124 (or ribs 121) when lid 110 is snap-fittingly associated with cup 128.

Cup wall 130 is preferably constructed of a translucent plastic material and includes a cup wall thickness n, wherein although cup wall thickness n is preferably 15/1000 inch, cup wall thickness n may be between about 9/1000 inch and about 25/1000 inch. In addition, although cup 128 is preferably constructed of a plastic and/or composite material, cup 128 may be constructed of any material and/or combination of materials suitable to the desired end purpose, such as paper and/or polyester (APET), polypropylene or polyethylene—alone or as a coating on a paperboard substrate—which are well suited from a child safety standpoint.

Figure 18:
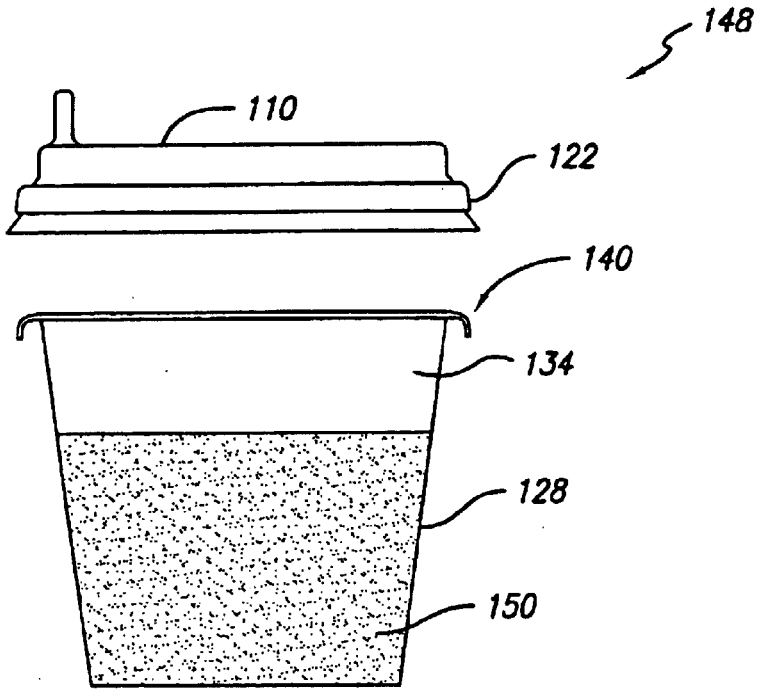
FIG. 18 is a cross sectional side view of a lid loosely associated with a cup.
Figure 19:
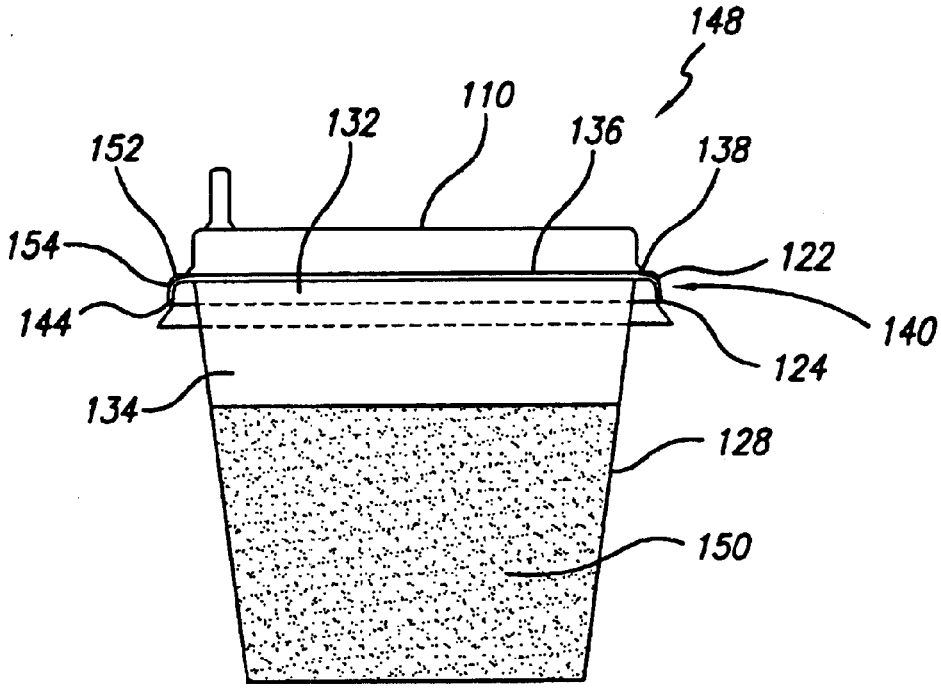
FIG. 19 is a cross sectional side view of a lid fasteningly associated with a cup.

Referring to FIG. 18, a disposable drinking device 148 is shown containing a liquid 150 within cup cavity 134 and having lid 110 disposed loosely associated with cup 128. Referring to FIG. 19, a disposable drinking device 148 is shown containing a liquid 150 within cup cavity 134 and having lid 110 snap-fittingly associated with cup 128. Cup 128 is shown with brim curl 138 in lip configuration 140, wherein brim curl diameter c is sized relative to skirt diameter a to allow brim curl 138 to sealingly associate with lid skirt 122 at a first sealing location 152 and a second sealing location 154. In addition, lip diameter d is sized relative to rim diameter b to allow brim lip 144 to fasteningly associate with angular rim 124 when lid 110 is snap-fittingly associated with cup 128, as shown in FIG. 16.

Figure 20:
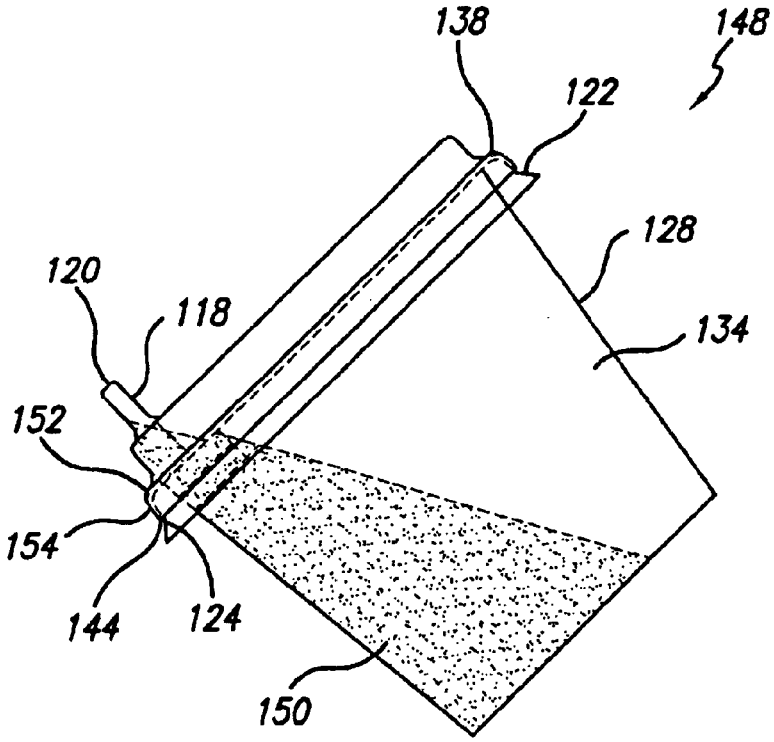
FIG. 20 is a side view of a tilted disposable drinking device.

Referring to FIG. 20, disposable drinking device 148 is shown in tilted fashion with lid 110 associated with cup 128 such that brim curl 138 is sealingly associated with lid skirt 122 at first sealing location 152 and second sealing location 154 and such that angular rim 124 is fasteningly associated with brim lip 144. The fact that brim curl 138 is sealingly associated with lid skirt and the fact that angular rim 124 is fasteningly associated with brim lip 144 advantageously allows disposable drinking device 148 to be tilted without spilling liquid 150 from cup cavity 134. Moreover, the fact that spout opening 120 is sized and/or shaped to contain liquid until suction is applied to lid spout 118 also advantageously allows disposable drinking device 148 to be tilted without spilling liquid 150 from cup cavity 134. In accordance with an exemplary embodiment, lid 110 and cup brim 136 are preferably round in shape and angular rim 124 is disposed relative to brim lip 144 to provide for a snap feature that snaps annularly about brim curl 138.

Lid 110 is novel and unique from existing lids in 1) that it is constructed using a thermoform process rather than via a mold injection process, 2) that interaction between angular rim 124 and brim lip 144 makes lid 128 easy to compress onto cup 128, but when lid is removed from cup, angular rim 124 pushes against brim lip 144 forcing brim curl 138 into flare configuration 142 (FIG. 17), thus destroying the seal at first sealing location 152 and second sealing location 154 (FIG. 19), 3) that it is formed from a clear material which allows visual identification of the type and level of liquid 150 disposed within cup 128, 4) that spout opening 120 is sized and/or shaped to minimize liquid from leaking from cup and 5) that disposable drinking device 148 is truly disposable.

Cup 128 is novel and unique from existing cups in that 1) cup 128 includes a configurable cup brim 136 for a true single-use purpose, 2) cup 128 may either be a paper cup or a cup constructed using a thermoform process and 3) cup 128 is easily stackable and thus easy to transport and/or package. Cup 128 is preferably a crush-resistant cup and includes a coating, such as a foam material, that provides tactile stimulation to a child using cup 128.

Figure 21:
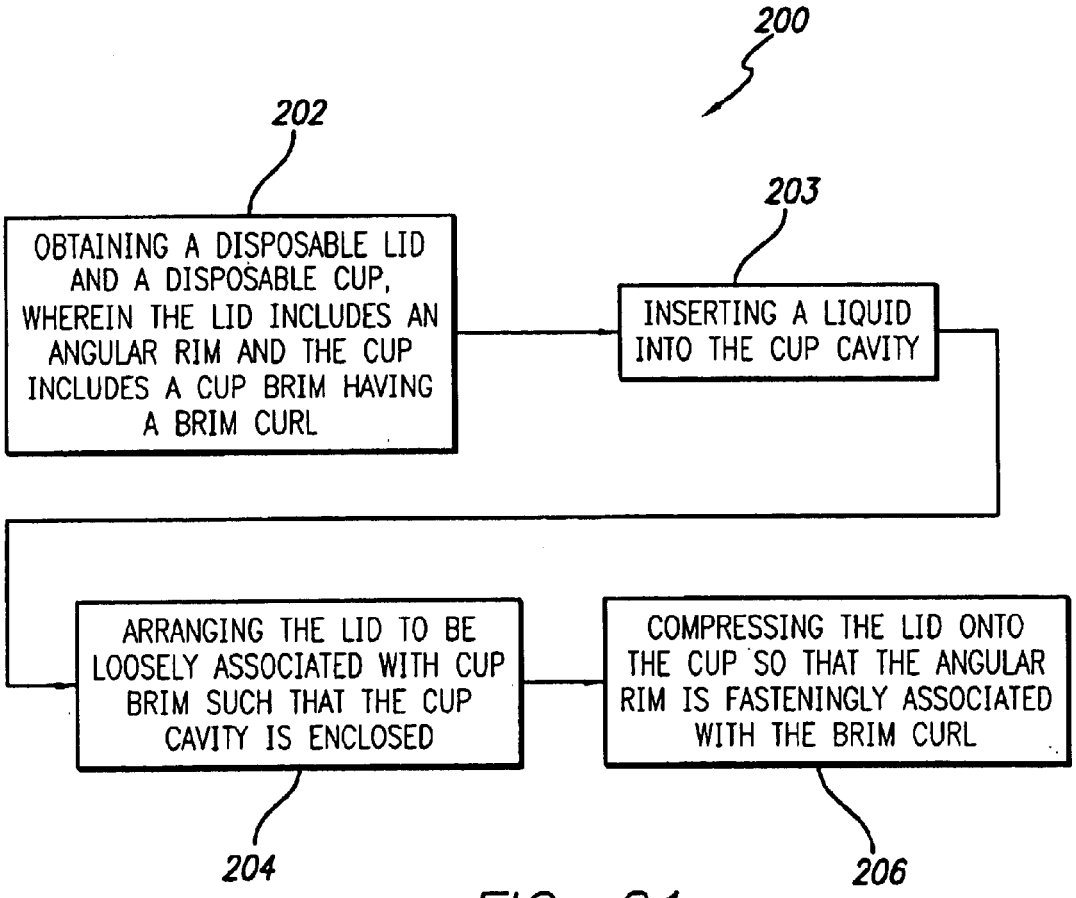
FIG. 21 is a block diagram illustrating a method for implementing a disposable drinking device.

Referring to FIG. 21, a method 200 for implementing disposable drinking device 148 is shown and described. As shown in blocks 202 and 203, lid 110 and cup 128 are obtained and a liquid 150 is inserted into cup cavity 134. Lid 110 is then arranged to be loosely associated with cup brim 136 and so as to loosely cover cup cavity 134, as shown in block 204. Lid 110 is then compressed onto cup brim 136, as shown in block 206, such that internal rim surface 126 of angular rim 124 becomes fasteningly associated with brim lip 144. At this point, disposable drinking device 148 is ready to be used and discarded after use.

In accordance with an exemplary embodiment, while a disposable drinking device 148 and a method 200 for implementing the same is described and discussed below it should be understood that the method and device of the invention may be applied to other product containers, such as storage bowls, serving bowls, plates and/or insulated cups.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A disposable drinking device comprising:

a cup, wherein the cup defines a cup cavity and includes a cup opening communicated with the cup cavity and a cup brim associated with the cup opening, the cup brim including a brim curl having a lip configuration and a flare configuration, wherein when the brim curl is in the lip configuration, the brim curl arcuately and concavely extends away from the cup opening to form a brim lip and wherein when the brim curl is in the flare configuration, the brim curl arcuately and convexly extends away from the cup opening to form a brim flare; and a thermoformed lid having a lid crown and a lid skirt, wherein the lid crown further comprises a crown top, a crown bottom and a spout having a spout opening disposed to communicate the crown top with the crown bottom, and wherein the lid skirt comprises an angular rim having an internal rim surface, wherein when the lid is snap-fittingly associated with the cup, the brim curl is in the lip configuration and the internal rim surface is securingly associated with the brim lip, such that when the lid is disassociated from the cup, the internal rim surface forcingly configures the brim curl into the flare configuration.

2. The disposable drinking device of claim 1, wherein the cup is constructed of a plastic material and comprises a cup wall having a cup wall thickness, the cup wall thickness being about $^{15}/_{1000}$ inch.

3. The disposable drinking device of claim 1, wherein the cup is constructed of a plastic material and includes a cup wall having a cup wall thickness the cup wall thickness being between about $^{9}/_{1000}$ inch and about $^{25}/_{1000}$ inch.

4. The disposable drinking device of claim 1, wherein the cup is constructed using a thermoformed process and comprises a cup surface having a surface laminate constructed from a foam material.

5. The disposable drinking device of claim 1, wherein the cup is constructed of a paper material.

6. The disposable drinking device of claim 1, the cup brim having a brim curl diameter and the lid skirt having a skirt diameter, the brim curl diameter being sized relative to the skirt diameter to allow the lid skirt to sealingly associate with the brim curl.

7. The disposable drinking device of claim 1, wherein the cup includes a cup wall, and wherein when the brim curl is in the lip configuration, the brim curl forms an arc angle between about 135° to about 225° along a line tangent to the cup wall.

8. The disposable drinking device of claim 1, wherein the brim lip includes a lip diameter and wherein the angular rim includes a rim diameter, the rim diameter is sized relative to the lip diameter to allow the brim lip to fasteningly associate with the angular rim.

9. The disposable drinking device of claim 1, wherein the spout opening is disposed to allow communication with the cup cavity when the lid is associated with the cup.

10. The disposable drinking device of claim 1, wherein the lid spout comprises an opening border and wherein the spout opening is shaped to allow the opening border to increase in size when suction is applied to the lid spout.

11. The disposable drinking device of claim 1, wherein the lid is constructed of a plastic material and includes a lid thickness, the lid thickness being about $^{10}/_{1000}$ inch.

12. The disposable drinking device of claim 1, wherein the lid is constructed of a plastic material and includes a lid thickness the lid thickness being between about $^{9}/_{1000}$ inch and about $^{25}/_{1000}$ inch.

13. A disposable cup comprising:

a cup wall defining a cup cavity and including a cup opening communicated with the cup cavity, and a cup brim annularly associated with the cup opening, wherein the cup brim comprises a partially formed brim curl having a lip configuration and a flare configuration, wherein when the brim curl is in the lip configuration, the brim curl arcuately and concavely extends away from the cup opening to form a brim lip, and wherein when the brim curl is in the flare configuration, the brim curl arcuately and convexly extends away from the cup opening to form a brim flare.

14. The cup of claim 13, wherein the cup is constructed of a plastic material and includes a cup wall thickness, the cup wall thickness being about $^{15}/_{1000}$ inch.

15. The cup of claim 13, wherein the cup is constructed of a plastic material and includes a cup wall thickness the cup wall thickness being between about $^{9}/_{1000}$ inch and about $^{25}/_{1000}$ inch.

16. The cup of claim 13, wherein the cup is constructed using a thermoformed process.

17. The cup of claim 13, wherein the cup includes a cup surface having a surface laminate at least a portion of which is foam material.

18. The cup of claim 13, wherein the cup is constructed of a paper material.

19. The cup of claim 13, wherein the cup brim comprises a brim curl diameter sized to allow the brim curl to sealingly associate with a lid skirt of a disposable lid.

20. The cup of claim 13, wherein when the brim curl is in the lip configuration the brim curl includes an arc angle between about 135° to about 225° from a line tangent to the cup wall.

21. The cup of claim 13, wherein the brim lip comprises a lip diameter sized to allow the brim lip to fasteningly associate with an angular rim of a disposable lid.

22. A method for implementing a disposable drinking device comprising:

obtaining a disposable lid and a disposable cup, the lid comprising a lid skirt having an angular rim, the cup comprising a cup opening, a cup brim and defining a cup cavity, the cup brim having a brim curl, wherein the brim curl can be in a lip configuration or a flare configuration;

inserting a liquid into the cup cavity;

arranging the lid and the cup to associate the lid with the cup brim to enclose the cup cavity; and pressing the lid onto the cup brim to associate the angular rim with the brim curl.

23. The method of claim 22, wherein the brim curl comprises a brim curl diameter and wherein the lid skirt comprises a skirt diameter, the brim curl diameter being sized relative to the skirt diameter to allow the lid skirt to sealingly associate with the brim curl.

24. The method of claim 22, wherein the brim curl comprises a brim lip having a lip diameter, and wherein the angular rim comprises a rim diameter, the rim diameter being sized relative to the lip diameter to allow the brim lip to fasteningly associate with the angular rim when the lid is associated with the cup.

25. The method of claim 22, wherein the lid comprises a lid crown having a crown top, a crown bottom and a protruding spout, wherein the protruding spout comprises a spout opening disposed to allow communication with the cup cavity when the lid is associated with the cup.

26. The method of claim 22, wherein the obtaining a disposable lid and a disposable cup further comprises obtaining a liquid and disposing the liquid in the cup cavity.

27. The method of claim 22, wherein the arranging the lid and the cup comprises arranging the lid relative to the cup brim to associate the angular rim with the brim curl.

28. The method of claim 22, wherein the brim curl is partially formed.

* * * * *